United States Patent [19]

Wolf et al.

[11] Patent Number: 4,612,760

[45] Date of Patent: Sep. 23, 1986

[54] DRIVE FOR MULTIPLE-SPINDLE TWISTING OR SPINNING MACHINE

[75] Inventors: Horst Wolf, Albershausen; Friedrich Dinkelmann, Rechberghausen, both of Fed. Rep. of Germany

[73] Assignee: Zinser Textilmaschinen GmbH, Ebersbach, Fed. Rep. of Germany

[21] Appl. No.: 812,253

[22] Filed: Dec. 23, 1985

[30] Foreign Application Priority Data

Jan. 7, 1985 [DE] Fed. Rep. of Germany ..... 3500322

[51] Int. Cl.[4] ..... D01H 1/241; F16H 7/02

[52] U.S. Cl. ..... 57/105; 57/92; 57/100; 474/148

[58] Field of Search ..... 57/104, 105, 100, 92, 57/93; 474/133–135, 148–150

[56] References Cited

U.S. PATENT DOCUMENTS

| | | | |
|---|---|---|---|
| 1,442,037 | 1/1923 | Bamford | 57/105 |
| 1,804,091 | 5/1931 | Durand | 57/105 X |
| 1,983,038 | 12/1934 | Lenk | 57/105 |
| 3,352,095 | 11/1967 | Heumann | 57/105 |
| 4,051,656 | 10/1977 | Burri et al. | 57/105 |
| 4,090,348 | 5/1978 | De Vittorio | 57/105 |
| 4,114,359 | 9/1978 | Creus | 57/104 X |
| 4,161,862 | 7/1979 | Hartmannsgruber et al. | 57/92 |
| 4,265,081 | 5/1981 | Creus | 57/105 X |

FOREIGN PATENT DOCUMENTS

| | | | |
|---|---|---|---|
| 263107 | 3/1929 | Italy | 57/105 |
| WO84/02932 | 8/1984 | PCT Int'l Appl. . | |
| 116782 | 9/1926 | Switzerland | 57/104 |
| 446142 | 3/1968 | Switzerland | 57/105 |

*Primary Examiner*—John Petrakes

*Attorney, Agent, or Firm*—Karl F. Ross; Herbert Dubno

[57] ABSTRACT

A spinning or twisting machine has a plurality of spindles which are rotatable about upright axes aligned in a row and which are each provided with a whorl tangentially engaged by the outer face of a straight stretch of a flat drive belt. This machine is driven by a system comprising a motor having an output pulley rotatable about an upright axis adjacent the flat drive belt, a drive wheel operatively tangentially engaging one face of the flat drive belt at a drive location, and another belt reeved over the output pulley and drive wheel and driving the latter from the former. A pinch roller is operatively engageable with the other face of the flat belt at the drive location and is pressed thereagainst to pinch the flat belt between the pinch roller and the drive wheel.

14 Claims, 9 Drawing Figures

DRIVE FOR MULTIPLE-SPINDLE TWISTING OR SPINNING MACHINE

FIELD OF THE INVENTION

The present invention relates to a multiple-spindle twisting or spinning machine. More particularly this invention concerns a flat-belt drive for such a machine.

BACKGROUND OF THE INVENTION

A standard twisting or spinning machine or other filament winding or unwinding machine normally has a battery of spindles each adapted to hold a single yarn package and rotatable about respective upright axes. As a rule the spindles are arranged in banks, that is in at least two parallel horizontal rows next to one another, with one bank being accessible from one side of the machine and the other bank being accessible from the other side.

Each spindle has a drive whorl, a barrel-shaped drive pulley, and all of the whorls of each bank are longitudinally aligned. They are driven by a flat belt has a stretch extending along each side of the machine and has an inner face engaging all of the respective whorls and an outer face that is engaged with idler wheels between the whorls. These idlers press the belt against the whorls for good force-transmitting contact. Such a drive is used because it makes it possible to stop a single spindle during servicing or reloading without having to shut down the whole machine.

As described in PCT application WO 84/02932 a single flat belt having one stretch along one side of the machine and another stretch along another side of the machine is deflected at each end of the machine over two rollers so that it has at each end a short transversely extensing straight stretch. A drive wheel carried directly on the output of a drive motor engages one of these transverse stretches. Such an arrangement requires that considerable space be left inside the machine for this drive motor.

In German patent document No. 2,204,593 there is on each side of the machine a flat tangential-type drive belt. A belt drive and a single motor drives both such flat belts. Such an arrangement is fairly complex and expensive and does not ensure accurate synchronization of movement of the two flat belts.

OBJECTS OF THE INVENTION

It is therefore an object of the present invention to provide an improved flat-belt drive system for a spinning or twisting machine or the like.

Another object is the provision of such a flat-belt drive system for a spinning or twisting machine or the like which overcomes the above-given disadvantages, that is which is simple and compact and which ensures perfectly synchronous operation of the belts on opposite sides of the machine.

SUMMARY OF THE INVENTION

The drive system of this invention is used in combination with a spinning or twisting machine having a plurality of spindles which are rotatable about upright axes aligned in a row and which are each provided with a whorl tangentially engaged by the outer face of a straight stretch of a flat drive belt. The drive system comprises a motor having an output pulley rotatable about an upright axis adjacent the flat drive belt, a drive wheel operatively tangentially engaging one face of the flat drive belt at a drive location, and another belt reeved over the output pulley and drive wheel and driving the latter from the former. A pinch roller is operatively engageable with the other face of the flat belt at the drive location and is pressed thereagainst to pinch the flat belt between the pinch roller and the drive wheel.

This has the advantage that it is very easy to integrate the drive motor, whose output shaft directly carries the pulley, into the machine. In addition excellent force transmission from the motor to the endless flat belt is thereby assured. The flat drive belt is tensioned between the drive wheel and the pinch roller so that such force transmission cannot fail.

According to another feature of this invention the flat belt has an inner face engaging the drive wheel and the outer face engages the pinch roller. In addition the spindles are arranged in two such rows engaging two such straight stretches of the flat belt and the drive has two such drive wheels engaging the other belt and respectively engaging the stretches of the flat belt on the inner face thereof. This system reduces tension in the flat belt by half since it is driven at two locations, while at the same time perfectly synchronous movement of both stretches of the flat belt is certain.

The tension in the flat belt can be reduced even further by using a plurality of such drive systems having drive wheels spaced along the respective stretches. In addition according to this invention tensioning means is provided for drawing the other belt tightly around the drive wheel and output pulley. This tensioning means can be a wheel pushed laterally against the other belt or the motor can be displaceable toward and away from the drive wheel so it constitutes the tensioning means. This prevents slip between the output pulley of the motor and the drive wheel.

According to another feature of the invention the flat belt is spring loaded by the pinch roller or is spring loaded by the drive wheels. The drive belt can be a flat or profiled belt.

DESCRIPTION OF THE DRAWINGS

The above and other features and advantages will become more readily apparent from the following, it being understood that any feature described with reference to one embodiment of the invention can be used where possible with any other embodiment. In the accompanying drawing.

SPECIFIC DESCRIPTION

Figure 1:
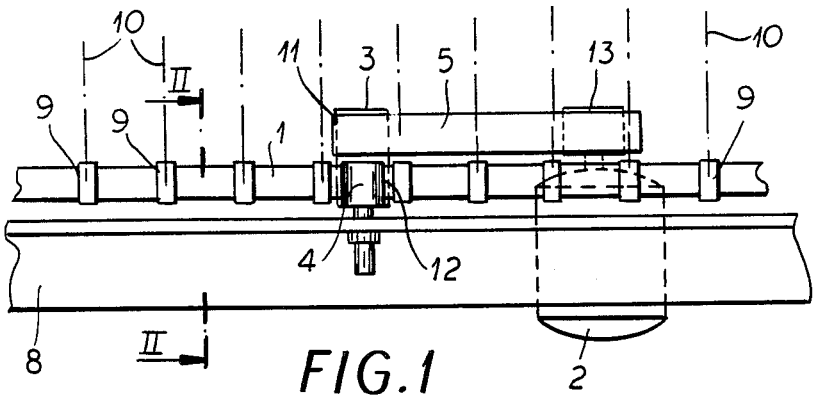
FIG. 1 is a partly diagrammatic side view of the apparatus of this invention.
Figure 2:
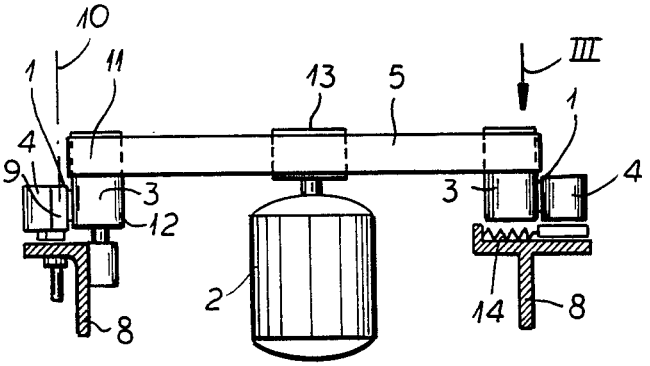
FIG. 2 is a cross section taken along line II—II of FIG. 1.
Figure 3:
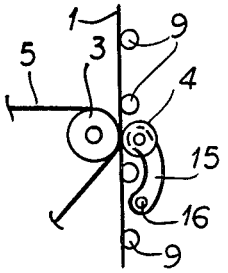
FIG. 3 is a top view of the detail indicated at III in FIG. 2.

As seen in FIGS. 1, 2, and 3 a drive system according to this invention serves to drive a plurality of spindles shown schematically at 10 and each having a respective drive whorl 9 rotatable in a machine frame 8 about a respective upright drive axis. The whorls 9 are arranged in two parallel rows horizontally level with each other and with the axes of each row coplanar. The whorls engage the outside face of a flat tangential-type drive belt 1 having one straight stretch extending along one side of the machine and another stretch extending along the opposite side.

The drive system of this invention comprises an electric drive motor 2 fixed on the frame 8 between the banks of spindles 10 and carrying a mainly cylindrical drive pulley 13 lying somewhat above the belt 1 and rotatable about a vertical axis parallel to the spindles 10. A flat drive belt 5 is spanned around this pulley 13 and around two smaller and identical drive wheels 3 rotatable about vertical axes and tangent to the inner face of the belt 1 between whorls 9 as seen in FIG. 1. Tension rollers 4 rotatable about vertical axes on the ends of respective arms 15 mounted on vertical pivots 16 outside the belt 1 are pulled by respective tension springs 14 into engagement with the outside face of the belt 1 exactly opposite the wheels 3. Thus these wheels 4 insure good force-transmitting contact between the belt 1 and the wheels 3 driven by the belt 5 which may be flat or profiled. As seen in FIGS. 1 and 2 each of the wheels 3 has an upper portion level with the wheel 13 and engaging the belt 5 and a lower portion 12 engaging the belt 4.

Figure 4:
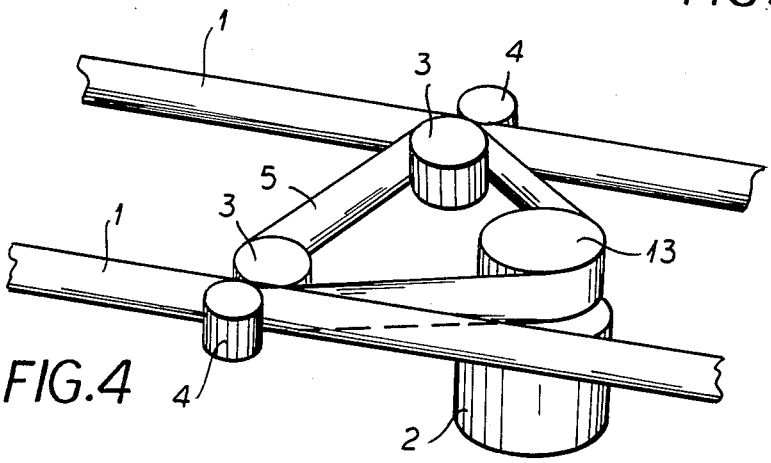
FIG. 4 is a perspective view of a second embodiment of the drive system of this invention.

The arrangement of FIG. 4 is similar to that of Figs. 1 through 3, but the wheels 3 are short so that the wheels 4 press both the belts 1 and 5 against the wheels 3. In this arrangement, therefore, the belt 5 and pulley 13 are level with the belt 1. In addition in this arrangement two separate belts 1 are driven.

Figure 5:
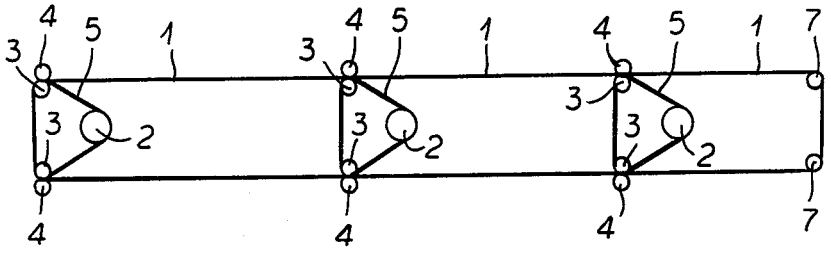
FIGS. 5, 6, 7, 8, and 9 are mainly diagrammatic top views of further drive systems in accordance with this invention.

In the arrangement of FIG. 5 three drive units each comprising a motor 2, wheels 3, and belt 5 are used with a single belt 1. Furthermore this belt 1 is deflected at one end, the left-hand end in the drawing, over the wheels 3 to ride in the short transverse end stretch flat on the belt 5.

Figure 6:
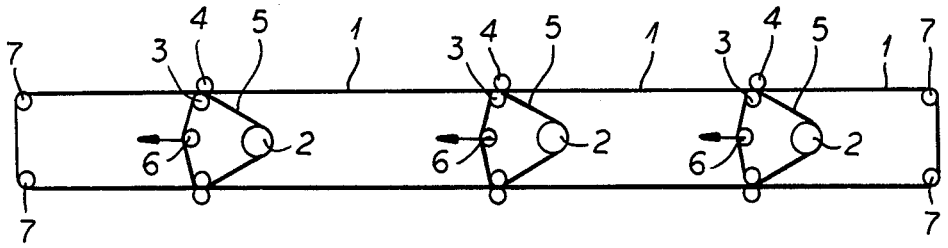

The arrangement of FIG. 6 is similar to that of FIG. 5 except that deflector rolls 7 are used at all four corners of the belt 1, and tension rolls 6 push the belts 5 away from the respective motors 2 to tension these belts 5.

Figure 7:
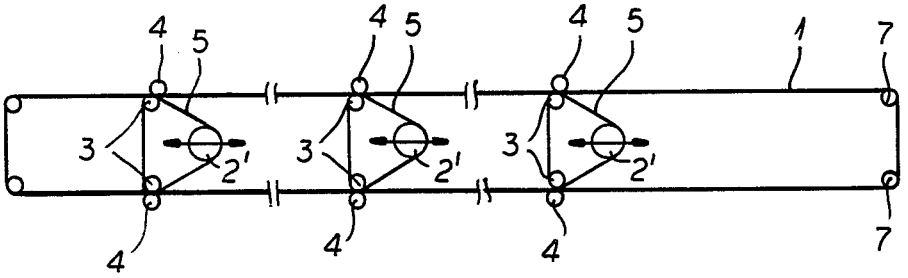

The system of FIG. 7 is identical to that of FIG. 5 except that instead of the tension rolls 6, motors 2' are used which are spring biased longitudinally away from the rolls 3. This ca be done by mounting the motors 2' on arms like the arms 15 of FIG. 3.

Figure 8:
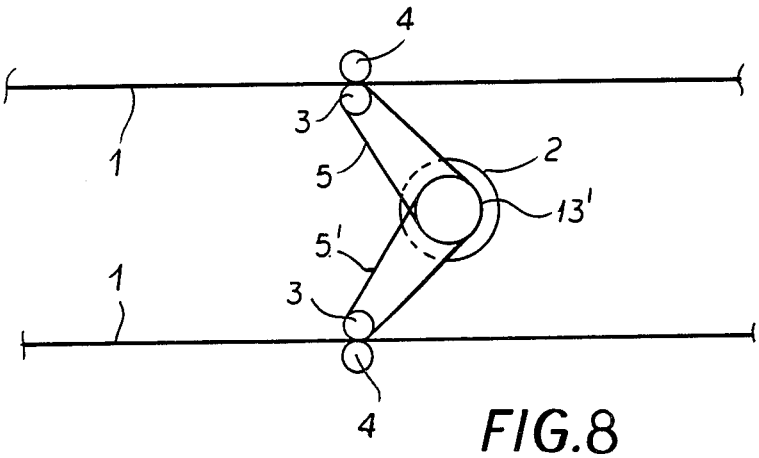
Figure 9:
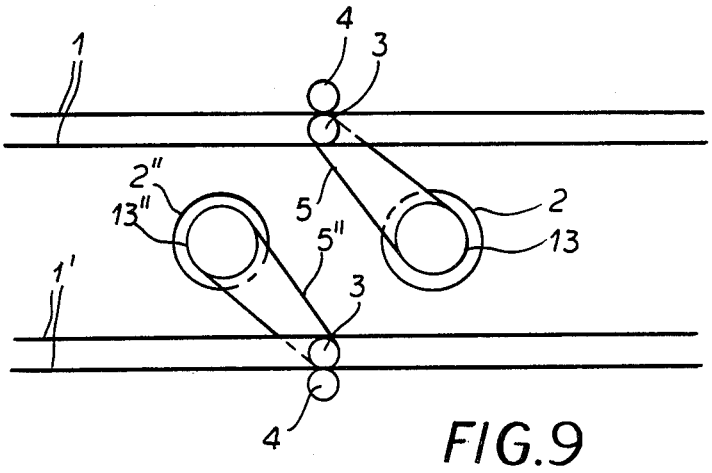

In FIG. 8 the pulley 13' is of double height so it can drive the belt 5 and another belt 5' spanned over respective wheels 3. Similarly in FIG. 9 two separate motors 2 and 2'' are used having respective pulleys 13 and 13'' driving respective belts 5 and 5'' engaging respective different drive belts 1 and 1'.

All of these last-described embodiments allow the drive system of the instant invention to be adapted to particular machine requirements.

We claim:

1. In combination with a spinning or twisting machine having a plurality of spindles rotatable about upright axes aligned in a row and each provided with a whorl tangentially engaged by the outer face of a straight stretch of a flat drive belt, a drive system comprising:

a motor having an output pulley rotatable about an upright axis adjacent the flat drive belt;

a drive wheel operatively tangentially engaging one face of the flat drive belt at a drive location;

another belt reeved over the output pulley and drive wheel and driving the latter from the former;

a pinch roller operatively engageable with the other face of the flat belt at the drive location; and biasing means for pressing the pinch roller against the other face of the belt at the location and thereby pinching the flat belt between the pinch roller and the drive wheel.

2. The drive system defined in claim 1 wherein the flat belt has an inner face engaging the drive wheel and the outer face engages the pinch roller.

3. The drive system defined in claim 2 wherein the spindles are arranged in two such rows engaging two such straight stretches of the flat belt, the system having two such drive wheels engaging the other belt and respectively engaging the stretches of the flat belt on the inner face thereof.

4. The drive system defined in claim 3 wherein a plurality of such drive systems are provided having drive wheels spaced along the respective stretches.

5. The drive system defined in claim 3, further comprising tensioning means for drawing the other belt tightly around the drive wheel and output pulley.

6. The drive system defined in claim 5 wherein the tensioning means is a wheel pushed laterally against the other belt.

7. The drive system defined in claim 5 wherein the motor is displaceable toward and away from the drive wheel and constitutes the tensioning means.

8. The drive system defined in claim 2 wherein the flat belt is spring loaded by the pinch roller.

9. The drive system defined in claim 2 wherein the flat belt is spring loaded by the drive wheels.

10. The drive system defined in claim 2 wherein the drive belt is a flat or profiled belt.

11. The drive system defined in claim 2 wherein the other belt engages the drive wheel vertically offset from the flat belt.

12. The drive system defined in claim 2 wherein the other belt is level with the flat belt and is pinched by the pinch roller with the flat belt between the drive wheel and the pinch roller.

13. The drive system defined in claim 12 wherein the other belt is also a flat belt.

14. The drive system defined in claim 13 wherein the motor and drive wheel lie between the stretches.

* * * * *